United States Patent [19]

Dorrity et al.

[11] Patent Number: 4,748,706

[45] Date of Patent: Jun. 7, 1988

[54] MULTIPLE DYE LOT CONTINUOUS DYE RANGE

[75] Inventors: J. Lewis Dorrity, Greenwood; David P. Hambrick, Bamberg; J. Thomas Hip, Jr., Ninety Six, all of S.C.

[73] Assignee: Greenwood Mills, Inc., Greenwood, S.C.

[21] Appl. No.: 901,206

[22] Filed: Aug. 28, 1986

[51] Int. Cl.[4] ..... D06B 3/10

[52] U.S. Cl. ..... 8/151; 68/13 R

[58] Field of Search ..... 8/151, 149, 151.2; 68/13 R

[56] References Cited

U.S. PATENT DOCUMENTS

| | | | |
|---|---|---|---|
| 3,393,411 | 7/1968 | McElveen | 8/151 |
| 3,948,597 | 4/1976 | Sakaoka | 8/149 X |
| 3,997,291 | 12/1976 | Fleissner | 8/151 |
| 4,005,230 | 1/1977 | Fleissner | 8/149.1 |
| 4,106,896 | 8/1978 | Norris et al. | 8/62 |

OTHER PUBLICATIONS

Brochure, "Mangles with the Swimming Roll Kusters".
Brochure, "Dye Padders with Swimming-Roll Kusters".

*Primary Examiner*—Harvey C. Hornsby
*Assistant Examiner*—Frankie L. Stinson
*Attorney, Agent, or Firm*—Cushman, Darby & Cushman

[57] ABSTRACT

A method and apparatus for sequentially performing dye strikes on a continuous dye range from a plurality of dye lots to reduce downtime of the range. The apparatus employs two dye pans that are horizontally and vertically movable relative to the dye pad on the range so that each can be sequentially moved into and out of a dyeing position while the machine is running and fabric continues to move therethrough. The textile material includes a leader section ahead of the fabric to be dyed in a desired strike order, such as, for example comprised of three leaders with first and second dye strike patches positioned therebetween in order to provide first and second strikes or runs on a continuous basis without stopping the dye range.

4 Claims, 6 Drawing Sheets

MULTIPLE DYE LOT CONTINUOUS DYE RANGE

FIELD OF THE INVENTION

The invention relates to apparatus and a method of sequentially performing multiple, dye strikes on textile fabric that reduces strike time and improves the operation and efficiency of continuous dye ranges.

BACKGROUND OF THE PRESENT INVENTION

Prior to dyeing varying lengths of a textile product on a continuous dye range it is necessary to test the dye bath to determine whether the fabric will be dyed with the desired color or shade from that dye bath. The generally accepted procedure for making such a determination on a continuous dye range is to run through the dye range a relatively short length of the textile material to be dyed usually a 10 to 20 yards length, referred to as a strike or strike patch. Following the running of that strike patch, the dye range is stopped and a sample of the dyed fabric is cut out and then taken to a laboratory for a color or shade test. The results will allow the dye to determine whether the dye formulation is correct or whether additional adjustments in the dye formulation will be necessary to produce the correct fabric color.

One type of dye range is a thermosol dye range and the process for taking a strike and processing it can take approximately 35 minutes. For other ranges the test time can vary. Further, if the dye formulation is altered, this "strike" process may need to be repeated as many times as is necessary to determine that the changed dye formulation will yield the proper shade. Typically, it is not uncommon to take 2 or 3 strikes in order to determine that proper shade. Because the speed of a continuous dye range is about 100 yards per minute, short lots of 5000 to 10,000 yards or less cannot be efficiently run given the strike time involved in dyeing any fabric on a continuous range.

Norris et al, U.S. Pat. No. 4,106,896 relates to a method for producing multicolor printed web material. As a preliminary to the printing operation on a production length, Norris et al use a reusable lead web segment, in the form of a lead carpet, which is non-receptive to the dyes being employed in the printing system. This reusable lead segment is attached to the front end of the production material so that the printing operation can be first made on this lead portion, allowing the operation to be checked and any print misalignments adjusted by observing the print strike applied to that lead web segment. The lead web segment, being non-receptive to the dyes, will be cleaned during the dye-washing step to which the entire material will be subjected, with the cleaned lead web segment then being disconnected from the production piece and thus be available for another print start-up operation.

Fleissner, U.S. Pat. No. 4,005,230 discloses apparatus for continuously treating, especially dyeing and printing, of piece goods.

We are also aware of two applications where attempts have been made to accomplish a quick change between different events. One of these involved use of multiple finishing boxes in a water proofing operation or a permanent press line where two emersion pads were alternatively used. This did not involve a dye operation nor the accomplishing of multiple strikes. The other dealt with a Kuster Equipment Company developed of a quick change dye pan. A single dye pan was mounted so as to be pivotable within a fixed frame to allow its contents to be dumped when pivoted. Following pivoting, but with the pan still pivoted the pan would be cleaned by a clean out procedure using suitable spray apparatus for purposes of cleaning remaining dye stuff from the pan. Upon repivoting to its normal position the pan could be refilled with a new dye lot formulation. Accordingly, one entire dye lot and dyeing run would have to be finished before starting to dye using another lot as the first dye lot would have to be completely emptied and cleaned from the dye pan.

SUMMARY OF THE APPARATUS ACCORDING TO THE PRESENT INVENTION

The apparatus is comprised of a modified Kuster or similar dye pad on a continuous dye range. The area beneath the dye pad area has been modified to receive two independently operable dye pan frames, each supporting one dye pan, so that together the dye pans will hold two different but preferably shade compatible dye lots. The use of two such dye pans will increase the range efficiency by allowing the sequential production of multiple dye strikes whereby strike time will be cut substantially thus reducing the downtime for the continuous dye range between the testing and examination of dye strike swatches and the initiation of a production dye run. By working with multiple dye lots and keeping the range running for longer periods of time, the average strike time will be cut approximately in half which will not only save operating costs but will allow more and a wider variety of fabrics to be treated. If strikes are not required, lot changes can be made "on the run" and eliminate all down time between shade changes.

The pad area includes a pair of horizontally movable frame sections in which two dye pans are held. Each frame is provided with means for raising and lowering the dye pad supported thereon toward and away from the dye pad rolls themselves. In operation, a first pan containing a first dyestuff will be positioned beneath the dye pad rolls and upon a suitable control signal, will be raised vertically to position the dye rolls within the pan so that dyeing will commence on any fabric passing through the pad rolls. The lead section of the production fabric has also been modified. That lead section will be comprised of a first leader having a length that can vary from about 700 to 900 yards depending on the length of the dye range. That first leader will be followed in turn by first strike patch that can vary from about 10 to about 20 yards in length. The first strike patch will have to be long enough to eliminate any effect that the leader may have upon the dye bath in order to assure that a complete and full dyeing of that strike patch will have occured. This first stike will be followed by a second leader whose lengths can be shorter than the first leader, perhaps being only 300 to 700 yards in length. The purpose of employing the second leader and its length will be determined by the amount of time necessary to change from the first pan to the second pan and clear other sections of contaminants. Following the run through of the first strike patch, and while the second leader is running through the dye rolls, the first pan will be lowered out of its raised dyeing position back onto its support frame and that support frame will be moved to an "out of the way" position thereby clearing the way for the second dye pan to be moved to its "in" position beneath the dye rolls. The second dye pan can then be raised into its dyeing position with respect to the dye rolls. By this point in time, the last portions of the second leader should be passing through the dye rolls so that shortly thereafter a second strike patch of fabric will be contacted and dyed by the second dye bath. The second strike patch will be equally as long as the first stike patch, about 10 to 20 yards, or again long enough again to eliminate any effect that the second leader may have had upon the second dye bath. Upon exiting the dye range, a swatch will be cut from the first strike patch which will be taken for analysis, which analysis will be ongoing during the run through of the second leader and during the dyeing of the second strike patch.

The second strike patch will be followed by a third leader which can be approximately as long as the first leader, about 700 to 900 yards in length.

In conventional continuous dye systems, where only one pad is used, one would normally take a first stike as described above by employing a leader and a first strike swatch section. Following the dyeing of that strike, the range run would be stopped perhaps for as long as 35 minutes to one hour to allow that strike to be checked. If modification were necessary in the dyestuff to produce the desired shade, the dyestuff would have to be modified by the addition of appropriate chemicals and dyes and a second strike taken to be sure that the modification to the dye bath was producing the correct and desired shade. This would require another strike check and another period where the machine was stopped. Thus, the machine could be stopped anywhere from ½ to about 2 hours to allow the various swatch checks to be undertaken. By employing the two dye pans the first swatch can be checked during the point in time while the second leader and second strike patch are being run through the machine.

Following the third leader it might be essential to have yet another strike that would operate with the first dye pan to check any corrections made to the first dye bath. This check would then operate as described above with respect to the first strike by having in the meantime lowered the second dye pan back to its "down" position within its support frame and moving the dye pan frame to its "out" position so the first dye pan can be repositioned beneath the dye rollers to dye a third strike patch.

If it were found that the second dye lot shade was correctly formulated, a production dye run of fabric dyed with the second dye stuff could be initiated immediately following the completion of the third strike without stopping the range or with only minimal machine downtime involving only the remainder of the checking interval required to complete analysis of the second strike patch beyond the time required to finish the third strike. Depending upon the length of the third leader as well as the leader portion between the third strike and the length of product textile to be dyed by the second dye lot, perhaps no machine downtime would be involved and operation could continue in a substantially continuous manner. Further, by the time dyeing of the production length of textile material was completed with the second dye lot and assuming that the test of the modified first dye lot proved to be correct, a leader could be provided between the first length of production fabric and the second length of production of fabric that was to be dyed with first dye lot. Such an extra leader could have a length suitable to accomodate the time necessary to change over from the second dye pan to the first pan with operation continuing without interruption.

The second pan could be emptied and cleaned during the dye run employing the first dye pan. A different dye lot could thereafter be prepared and placed in the second dye pan so that following completion of the dye run employing the first dye pan, another leader strip could be positioned at the end of that production piece being dyed to permit a strike from the new dye lot in the second dye pan to begin a new cycle of runs.

Average dye lots for textile lengths are getting smaller and rather than dyeing 20000 yard dye lots, dye lots on average are ranging from about 8000 to 10000 yards in length. Regardless of the lengths involved, however, the present invention can be used successfully to more rapidly and more efficiently dye a variety of lots and lot sizes than has previous equipment.

The fabrics that are being processed include all those comprised of blends of synthetic and natural fibers, such as, for example, polyester and cotton blends, all synthetic fabrics, fabrics made from all natural fibers or any other conventionally continuously dyeable textile fabric. Similarly, the dyestuffs that are contemplated will be any that can be produced normally on a continuous dye range equipment. The feed rate for the fabric throught the range can vary from about 60 to about 140 yards per minute with a preferred speed being approximately 100 yards per minute with the exact speed being selected depending upon fabric weight and the fiber content of the fabric.

Other objects, features, and characteristics of the present invention, as well as the methods and operations and functions of the related elements of the structure, and to the combination of parts and economies of manufacture, will become more apparent upon condsideration of the following description and the appended claims with reference to the accompanying drawings, all of which form a part of this specification, wherein like reference numerals designate corresponding parts in the various figures.

BRIEF DESCRIPTION OF THE DRAWINGS

FIG. 10 is a graph showing the efficiency of dyeing procedures; and

FIG. 11 is a graph composing lost sizes in yards versus added yards per week.

DETAILED DESCRIPTION OF THE PREFERRED EXEMPLARY EMBODIMENT ACCORDING TO THE PRESENT INVENTION

The present invention relates to the dye pad portion of a continuous dye range. Such a range would conventionally include a feed-in batcher for allowing the various lengths of textile material to be suitably connected together and fed into the range. This would be followed by the dye pad section which forms the subject of the present invention, and is followed in turn by a predryer, and then dry cans in a thermosol oven in order to fix the dye in polyester material. The fabric could then pass through a chemical pad to develop dye stuff, which is followed in turn by a steamer used to fix dye on cotton fabrics. The fabric would then pass through wash boxes and final dry cans to dry the washed fabric which will finally be collected on a take up beam or batcher before final processing.

Figure 1:
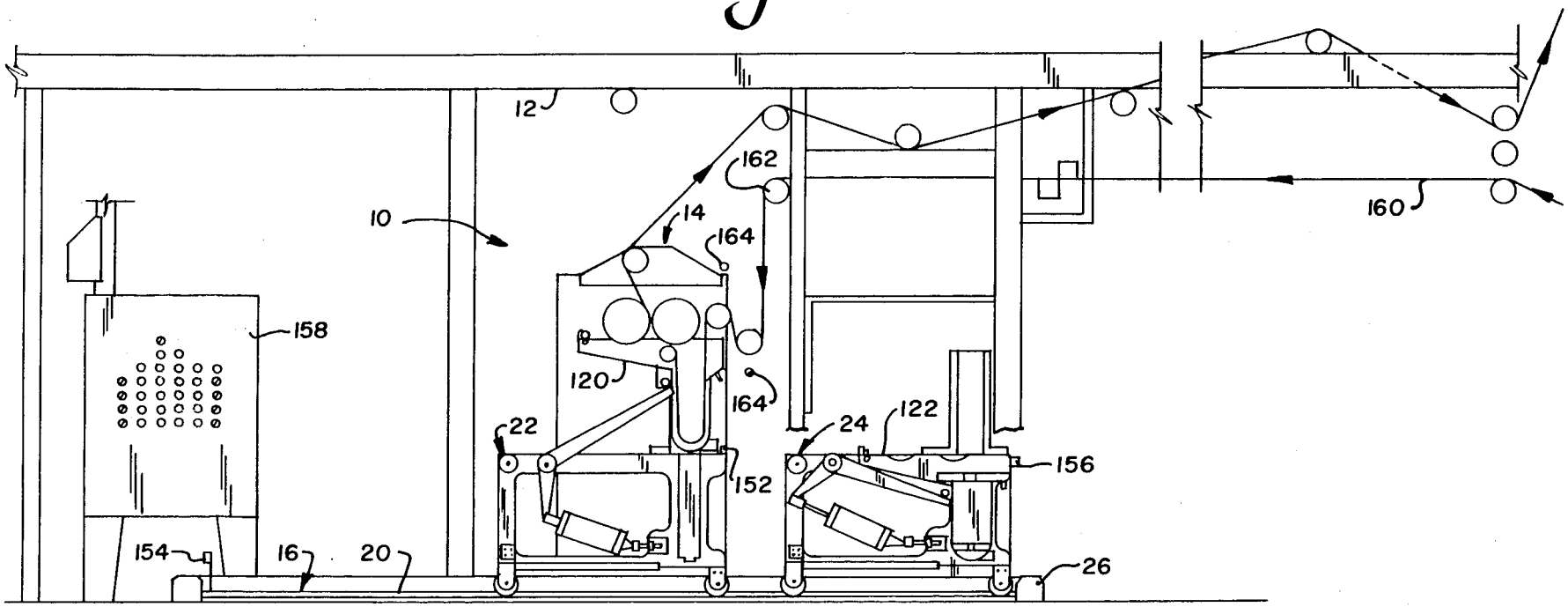
FIG. 1 is a side elevational view of apparatus according to the present invention used to accomplish the two pan dyeing process.
Figure 2:
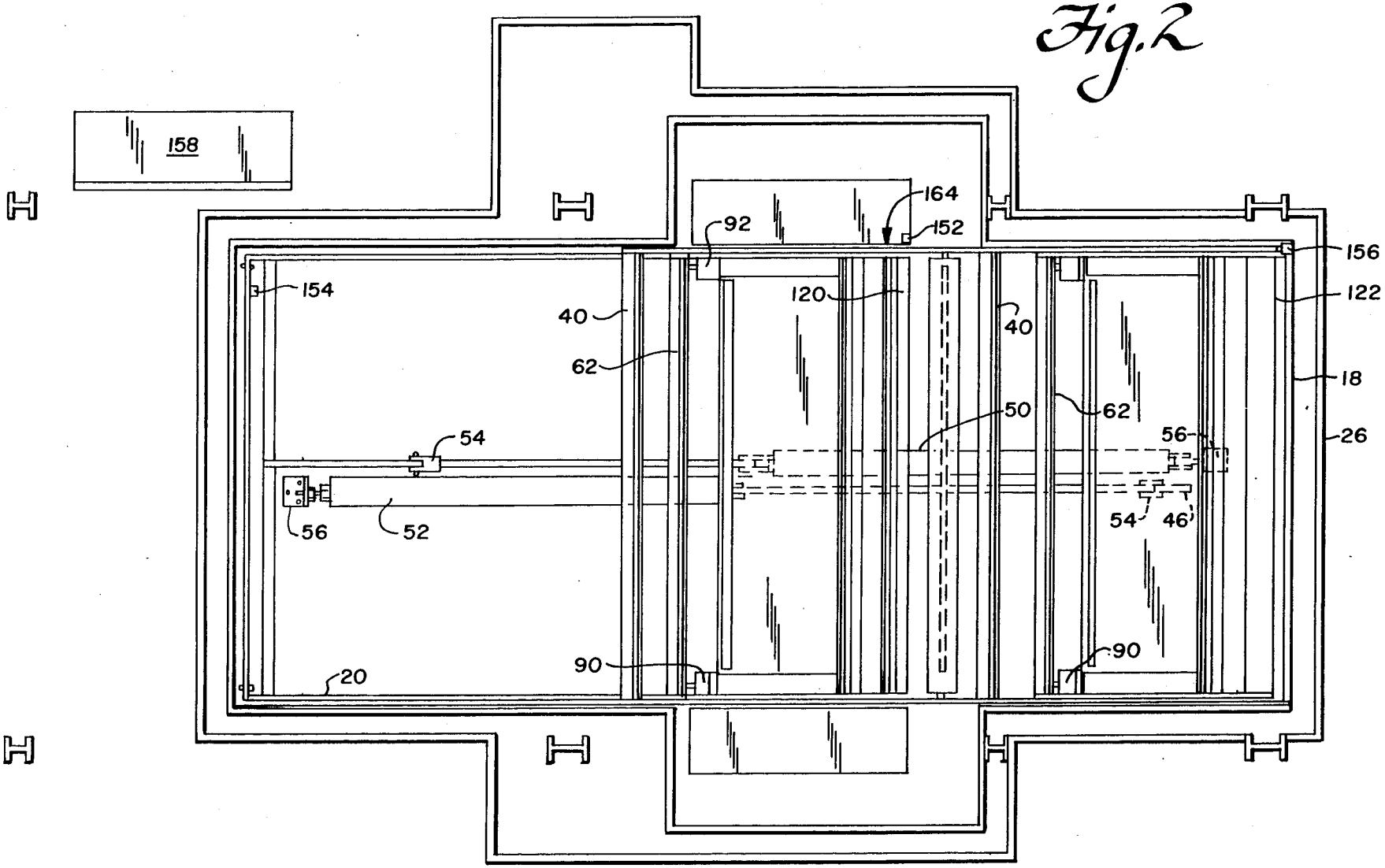
FIG. 2 is a top elevational view of the apparatus shown in FIG. 1.
Figure 3:
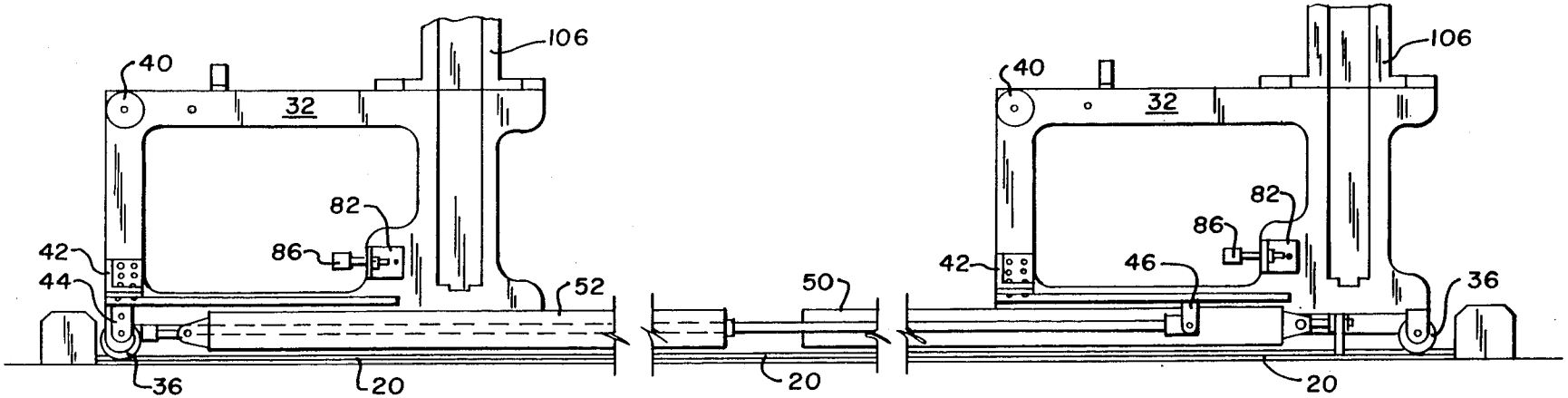
FIG. 3 is a cross-sectional view of a portion of the apparatus shown in FIG. 1 specifically showing the support frames for the dye pans.
Figure 4:
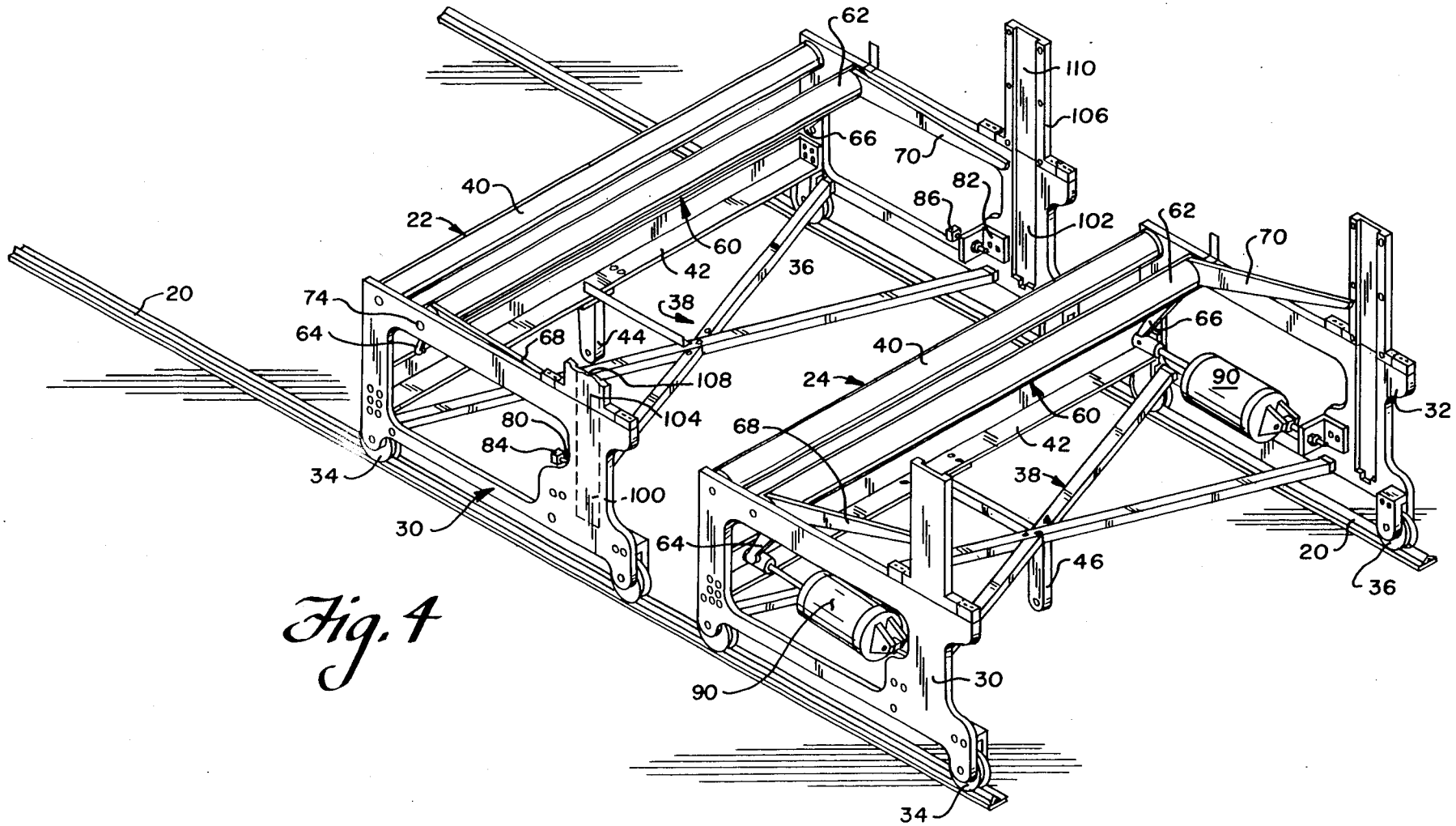
FIG. 4 is a darkermatic perspective view of the support frame shown in FIGS. 1 and 3.
Figure 5:
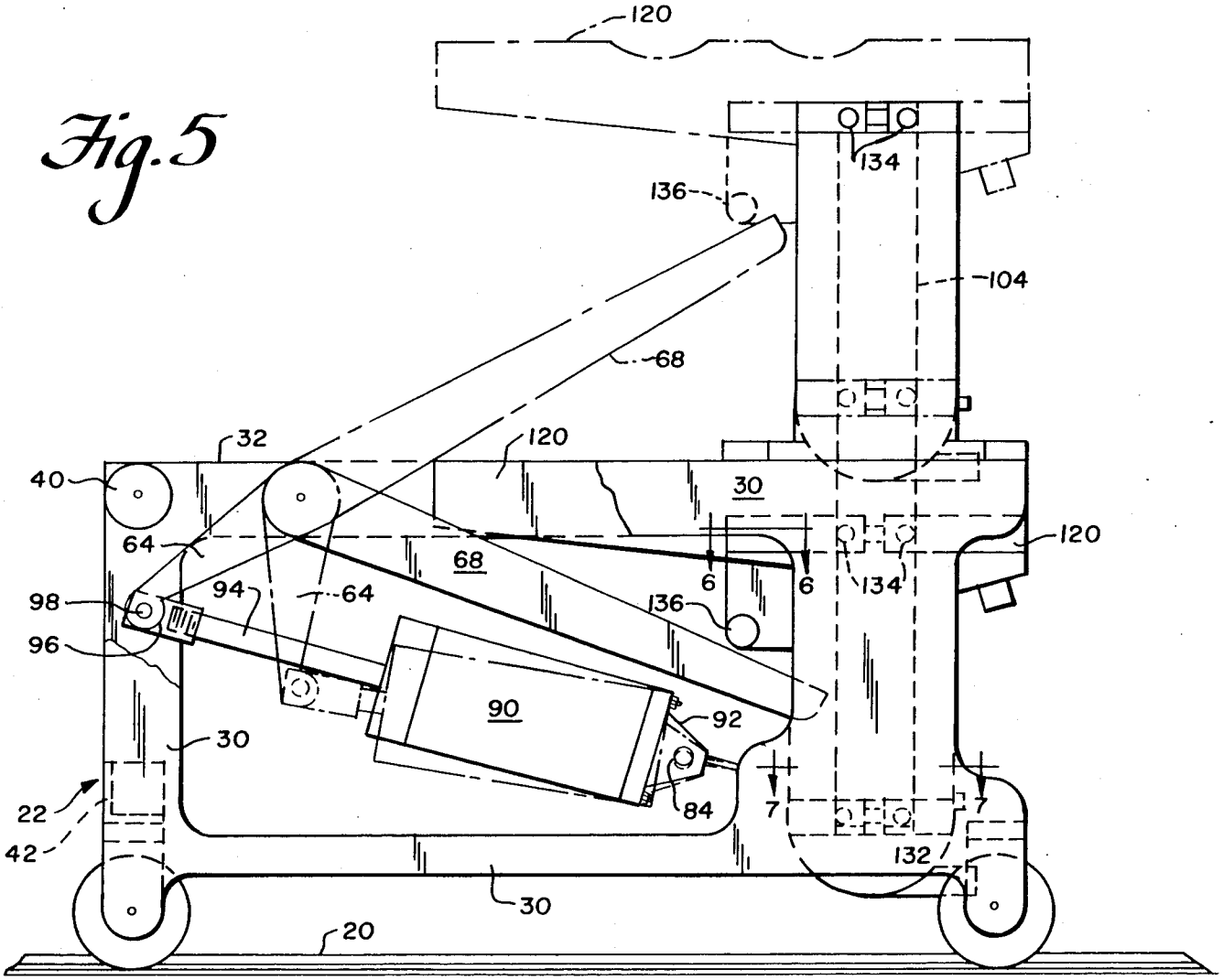
FIG. 5 is an enlarged partial side elevational view of the dye pan shown in its full line lowered and dotted line raised position.

In FIG. 1, the dyeing station is generally indicated at 10. The dye pad 14 is of conventional design, such as a Kuster dye pad, and does not form part of the present invention. Accordingly, additional discussion or further description of that is not deemed to be warranted for person skilled in the art to fully understand that portion of the dye range. Mounted there below is a support frame, generally indicated at 16, comprised of end rails 18 as shown in FIG. 2 and side rails 20. As shown in FIGS. 4 and 5, side rails 20 form the track on and along which two pan support pan frames at 22 and 24 operate. A cement curb 26 can also be provided at about the entire structure in order to control the flow of liquids around the dye pad unit.

Each of the dye pans support frames 22 and 24 is comprised of a pair of sidewalls 30 and 32 that respectively include a pair of wheels 34 and 36 which in turn rest on rail 20. A network of cross members generally indicated at 38 as well as main support cross beams 40 and 42 provide the internal structure between sidewalls 30 and 32. In addition, each of the frames 22 and 24 include a depending cylinder push arm 44 and 46, respectively, with arm 44 depending from cross member 42, as shown in FIG. 4, whereas arm 46 depends from a central connection point of the network 38 on frame 24. These depending arms provide the connection point for the frame control pistons 50 and 52 each respectively being connected thereto by clevis members 54 and 56. Each of the cylinders 50 and 52 are preferably Modern Air Series 08 air cylinders having a four inch bore and a stroke of approximately 62 inches. The opposite end of each cylinder is mounted directly to the floor such as by brackets 54 and 56, respectively.

Figure 9:
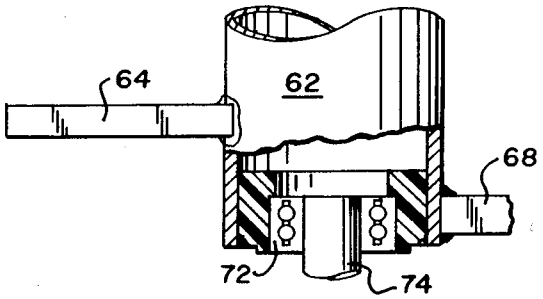
FIG. 9 is a sectional view of a lifting arm proportions in cross-section to show the mounting portion thereof.

With reference still to FIG. 4, frames 22 and 24 pivotly support a lift arm, generally indicated at 60, which is comprised of a horizontal pipe section 62 preferably 3½ inch diameter pipe to which a pair of push cylinder brackets 64 and 66 are attached at opposite ends such as by welding. Similarly attached at opposite ends, such as by welding, are two lift arms 68 and 70. In order to provide proper pivoting of lift arm 60, the ends of pipe 62 can be provided with an internal bore in which suitable bearings, generally indicated 72 in FIG. 9 can be provided with the arm being mounted between end walls 30 and 32 such as by means of mounting pins or bolts 74, also as shown in FIG. 9.

Preferably sidewalls 30 and 32 are spaced apart approximately 76 inches and are machined or otherwise formed from one inch steel plate stock. Each of the sidewalls support a mounting bracket as shown at 80 and 82 in which an adjustable mounting screw 84 and 86 is provided. Two air cylinders 90 and 92 are provided on each side of the pan support frame for providing the pivoting drive force necessary to raise and lower the dye pans. Each cylinder, 90 for example, has a mounting flange 92 mounted to the adjustable mounting screw 84. Each cylinder also includes a drive arm 94 and a fixed cap clevis 96 at the end of the drive arm which is mounted by means of a pin 98 to the lower end of the respective push cylinder bracket, as at 64. Each of the air cylinders 90 and 92 has a 6 inch bore and a 9 inch stroke, as in the ARO Series 40, heavy duty air cylinder.

Figure 7:
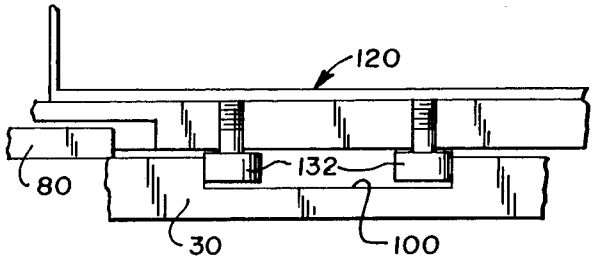
FIG. 7 is a cross-sectional view taken along lines 77 in FIG. 5.
Figure 6:
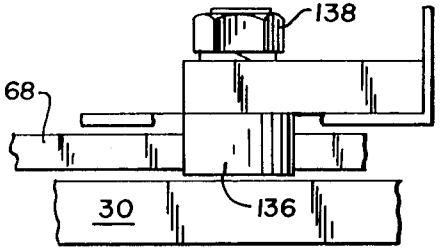
FIG. 6 is a cross-sectional view taken along lines 66 in FIG. 5.
Figure 8:
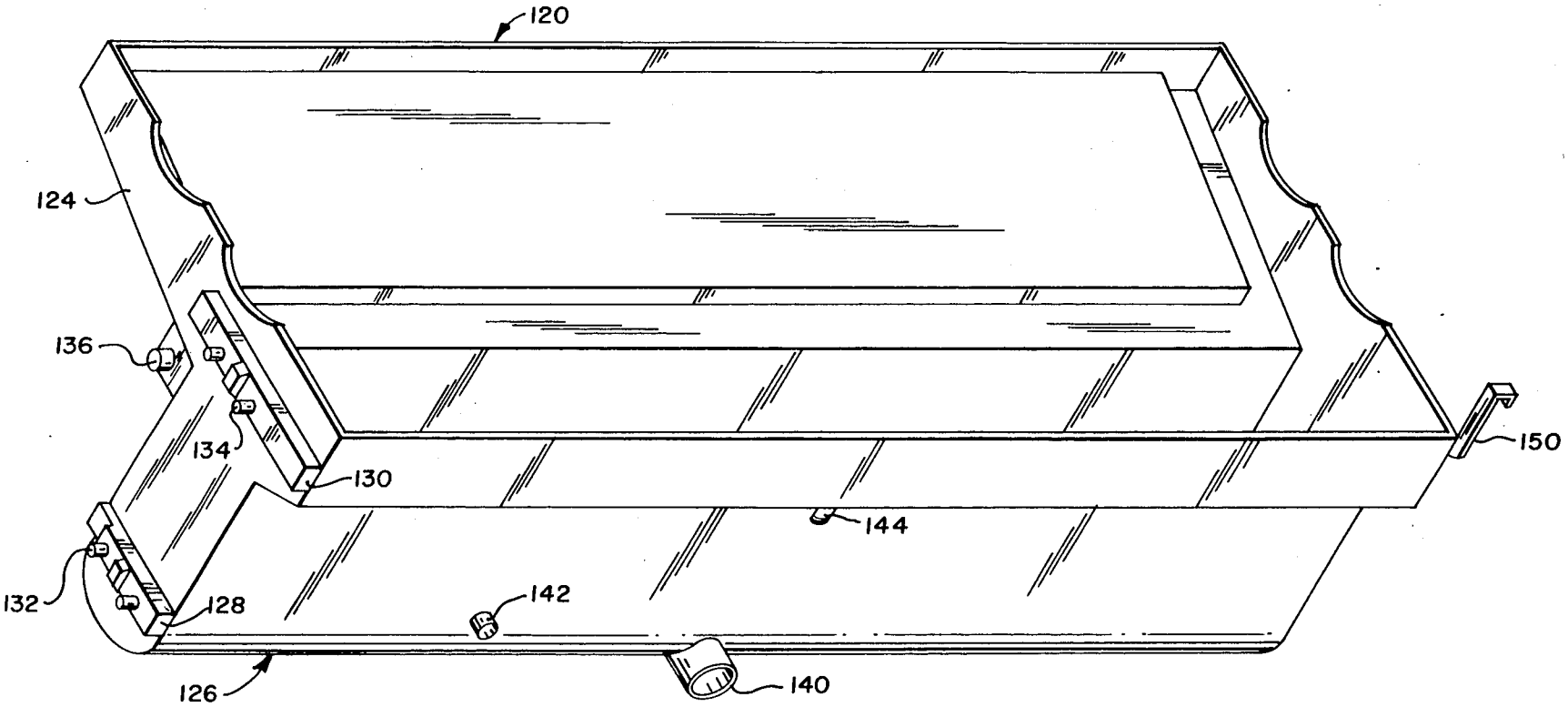
FIG. 8 is a diagramatic perspective view of one of the dye pans according to the present invention.

Turning again to FIG. 4, the interior surface of sidewalls 30 and 32 each are formed with a vertically extending slot 100 and 102 milled or otherwise formed at the end opposite support member 40. Further, a separate slot extension member 104 and 106 is mounted above slots 100 and 102 to increase the length of the slots. The dimensions of sidewalls 30 and 32 can be approximately 25 inches high and 48 inches long with extensions 104 and 106 each being approximately 20 inches in length. Extension members 104 and 106 are also provided with milled slots 108 and 110 that correspond to slots 100 and 102 so the total length of the veritical slot formed thereby is approximately 45 to about 50 inches. Mounted within frames 22 and 24 are dye pans 120 and 122 with dye pan 120 being shown in FIG. 8. Since both of the dye pans are the same, only one will be described in detail. The dye pan includes a generally horizontal rear section 124 in a depending dye roll receiving section in the forward portion at 126. The pan sidewall serves as a mounting surface for upper and lower support brackets 128 and 130 which respectively support pairs of rollers cams 132 and 134. The opposite side will be constructed in a similar manner and will not be separately described. The pairs of roller cams 132 and 134 will be received within the slots 100 and 108 on member 30 and 102 and 110 on sidewall 32. With reference to FIG. 7, the pair of lower cams 132 is shown within slot 100. Each of the pan sidewalls also includes a lifting cam roller 136 which can be held in place by means of a threaded rod and bolt assembly as shown in FIG. 6 at 138. Roller cam 136 will cooperate with lever arm 68 to permit the pan 120 to be raised and lowered. In FIG. 5, the pan is shown in a full line lowered position and in a dotted line raised position, with the raised position also being shown in FIG. 1 for pan 120. As indicated in FIG. 5, the extension members 104 and 106 will extend a sufficient distance above the top edge of sidewall 30 so that the length of slots 100 and 108 will extend at least as high as the position reached by the upper pair of support cam rollers 134 when the pan is fully raised thereby providing both lateral and horizontal support for the pans in their raised conditions. Likewise, the pan will be held in that vertical position by means of cylinders 90 and 92 operating through the linkage to lift arms 68.

Each of the pans also includes a bottom drain 140, a mount for a dye level control device 142, as well as an overflow drain 144. One side of the pan 120 will also include a proximity switch actuator 150 which will cooperate with a proximity switch positioned on the dye pad 14 as indicated at 152. Two other proximity switches 154 and 156 are also provided at the respective end points of travel for frames 22 and 24 on the opposite sides of the pad area. Proximity switch 152 will provide a control signal to the control apparatus 158 to indicate that the pan is down or in its lower position whereas switches 154 and 156 will provide suitable control signals to the control system, generally indicated at 158, indicating when the respective frames 22 or 24 are in their "out" position relative to the dye pad so that the air cylinders 90 and 92 for a particular frame will not be actuated until suitable signals are obtained.

OPERATING PROCEDURES

On the assumption that both of the pans 120 and 122 are empty, both pans will be filled with separate dye lots, dye lot 1 being in pan 120 and dye lot 2 being in pan 122. Dye pan 120 will then be moved into its position beneath the dye pad, with frame 22 as being in the position as shown in FIG. 1, but the pan will not yet be in its raised position as shown in FIG. 1. The range will be started so that textile material 160 will be fed over suitable guide rollers 162 into the dye pad 14 with the threading of the textile fabric 160 generally as shown in FIG. 1. The intial material passing through the dye range will be the first leader with pan 120 being moved to its raised or upward position approximately 20 to 30 yards of the first leader ahead of the first strike portion is reached. A spray manifold generally indicated at 164 will be actuated in order to provide a water rinse to clean the dye rolls as well as the other rolls within the system by the cloth leader. Pan 120 will then be moved into its raised position to dye the first strike patch. Following the completion of the dyeing of that first strike patch pan 120 will be lowered and frame 22 moved to its "out" position with the dye rolls then being further cleaned by additional spray and the action of the wet second leader. This occurs while the second leader is running and when the rolls are sufficiently clean and dripping of water has virtually stopped, frame 124 and pan 122 will be moved into the position beneath the dye pad 14 and just prior to the arrival of the second strike patch pan 122 will be raised to its up position and dyeing of the second strike patch will then proceed the same way the first strike patch was dyed. At the completion of the second strike patch pan 122 will be lowered and frame 24 will be moved to its out position and the dye rolls will then be cleaned by the next leader strip and the spray from manifold 164. If another strike is to be run then the operation with respect to frame 122 and pan 120 will be repeated. If the results from the first strike test have not been completed, the range will be stopped at the time when the second strike patch exits the range.

If an add is to be made to either the first or second dye lot the dye will preferably be pumped back to the mix tank where mixing can proceed in a more controlled way and if it is necessary that each of the dye lots be struck a second time the above procedure will be repeated. Dye could alternatively be dumped to a drain.

When dye lot 1 is ready to run, in assuming dye lot 2 is desirably to be struck again, dye lot 2 will be struck first by moving frame 24 again to the position beneath to its "in" position beneath the dye rolls and the dyeing sequence will proceed through the use of additional leaders and strike patches. At the end of that striking process, pan 122 will again be lowered and frame 24 will be moved to its out position and following cleaning of the dye rolls through an additional leader frame 22 will be moved from its "out" to its "in" position with dye pan 120 being raised to permit dyeing of the textile material to be dyed with that shade thereafter occuring. This can occur without stopping the range in between the striking of the second lot and the running of the first lot.

If the first dye lot required use of a second tank of dye stuff, a third tank of dye stuff can be prepared with lot 2 being prepared for its next strike to follow the completion of dye lot 1. At the end of that additional strike of dye lot 2 the range can be stopped and pan 1 can be prepared for an additional dye lot 4. On the assumption that dye lot 2 will now be ready to run it can be employed following the completion of the running of dye lot 1 and in addition dye lot 3 can be prepared for striking so that following the completion of the lot 2 run, pan 122 can be cleaned and filled with lot 3 at which time striking of lots 3 and 4 can proceed.

As shown in the following examples, production using the dual pan approach has increased the efficiency and has allowed additional yardage to be run on such ranges. In addition, two graphs with the first comparing lot sizes in thousands of yards versus the percent efficiency. The graph shown in FIG. 11 comprises lot sizes in yards versus added yards per week using this method. From the graph of FIG. 10, it can be noted that not because of the improved proposed efficiencies, even a drop off to about 5000 yard lots will still allow approximately a 50% efficiency in dyeing procedures using the apparatus and process continuous dye range as set forth herein.

TABLE 1

DUAL DYE ANAL
PRODUCTION WITH DUAL PAN-
-THOUSANDS OF YARDS

| | STRIKES/LOT = | | | | |
|---|---|---|---|---|---|
| LOT SIZE | 2 | 2.50 | 3.00 | 3.50 | 4 |
| 2000 | 1,245 | 1,051 | 907 | 796 | 709 |
| 5000 | 1,905 | 1,712 | 1,551 | 1,416 | 1,302 |
| 7500 | 2,160 | 1,990 | 1,842 | 1,713 | 1,600 |
| 10000 | 2,315 | 2,166 | 2,033 | 1,913 | 1,806 |
| 12500 | 2,419 | 2,288 | 2,167 | 2,058 | 1,958 |
| 15000 | 2,493 | 2,376 | 2,267 | 2,167 | 2,074 |
| 17500 | 2,549 | 2,444 | 2,345 | 2,252 | 2,165 |
| 20000 | 2,593 | 2,497 | 2,406 | 2,321 | 2,240 |

TABLE 2

DUAL DYE ANAL
STRIKES/LOT = 4 SPEED = 100 HOURS/WK = 138 LDR = 3

| LOT SIZE | PRESENT STRIKE TIME | EFFI-CIENCY | PROPOSED STRIKE TIME | EFFI-CIENCY | ADDITIONAL YARDS/WK RANGE | MACHINE HOURS SAVED | ADDED YARDS/WK FOUR RANGES (THOUS) | TOTAL YARDS/WK (THOUS) |
|---|---|---|---|---|---|---|---|---|
| 2000 | 35 | 11.12 | 15.80 | 21.39 | 85,029 | 14.17 | 340 | 709 |
| 5000 | 35 | 23.42 | 15.80 | 39.31 | 131,568 | 21.93 | 526 | 1,302 |
| 7500 | 35 | 31.05 | 15.80 | 48.30 | 142,855 | 23.81 | 571 | 1,600 |
| 10000 | 35 | 37.08 | 15.80 | 54.53 | 144,494 | 24.09 | 578 | 1,806 |
| 12500 | 35 | 41.98 | 15.80 | 59.11 | 141,849 | 23.64 | 567 | 1,958 |
| 15000 | 35 | 46.03 | 15.80 | 62.62 | 137,305 | 22.88 | 549 | 2,074 |
| 17500 | 35 | 49.44 | 15.80 | 65.39 | 131,998 | 22.00 | 528 | 2,166 |

TABLE 2-continued

| | | | DUAL DYE ANAL STRIKES/LOT = 4 SPEED = 100 HOURS/WK = 138 LDR = 3 | | | | | |
|---|---|---|---|---|---|---|---|---|
| LOT SIZE | PRESENT STRIKE TIME | EFFI-CIENCY | PROPOSED STRIKE TIME | EFFI-CIENCY | ADDITIONAL YARDS/WK RANGE | MACHINE HOURS SAVED | ADDED YARDS/WK FOUR RANGES (THOUS) | TOTAL YARDS/WK (THOUS) |
| 20000 | 35 | 52.35 | 15.80 | 67.63 | 126,487 | 21.08 | 506 | 2,240 |

INCLUDES MECHANICAL DOWNTIME

TABLE 3

| | | | DUAL DYE ANAL STRIKES/LOT = 3 SPEED = 100 HOURS/WK = 138 LDR = 3 | | | | | |
|---|---|---|---|---|---|---|---|---|
| LOT SIZE | PRESENT STRIKE TIME | EFFI-CIENCY | PROPOSED STRIKE TIME | EFFI-CIENCY | ADDITIONAL YARDS/WK/ RANGE | MACHINE HOURS SAVED | ADDED YARDS/WK FOUR RANGES (THOUS) | TOTAL YARDS/WK (THOUS) |
| 2000 | 35 | 14.24 | 15.00 | 27.38 | 108,837 | 18.14 | 435 | 907 |
| 5000 | 35 | 28.71 | 15.00 | 46.84 | 150,137 | 25.02 | 601 | 1,551 |
| 7500 | 35 | 37.08 | 15.00 | 55.62 | 153,525 | 25.59 | 614 | 1,842 |
| 10000 | 35 | 43.41 | 15.00 | 61.38 | 148,748 | 24.79 | 595 | 2,033 |
| 12500 | 35 | 48.37 | 15.00 | 65.44 | 141,353 | 23.56 | 565 | 2,167 |
| 15000 | 35 | 52.35 | 15.00 | 68.45 | 133,379 | 22.23 | 534 | 2,267 |
| 17500 | 35 | 55.62 | 15.00 | 70.80 | 125,611 | 20.94 | 502 | 2,345 |
| 20000 | 35 | 58.36 | 15.00 | 72.65 | 118,341 | 19.72 | 473 | 2,406 |

INCLUDES MECHANICAL DOWNTIME

TABLE 4

| | | | DUAL DYE ANAL STRIKES/LOT = 2 SPEED = 100 HOURS/WK = 138 LDR = 3 | | | | | |
|---|---|---|---|---|---|---|---|---|
| LOT SIZE | PRESENT STRIKE TIME | EFFI-CIENCY | PROPOSED STRIKE TIME | EFFI-CIENCY | ADDITIONAL YARDS/WK RANGE | MACHINE HOURS SAVED | ADDED YARDS/WK FOUR RANGES (THOUS) | TOTAL YARDS/WK (THOUS) |
| 2000 | 35 | 19.78 | 13.67 | 37.61 | 147,615 | 24.60 | 590 | 1,245 |
| 5000 | 35 | 37.08 | 13.67 | 57.54 | 169,407 | 28.23 | 678 | 1,906 |
| 7500 | 35 | 46.03 | 13.67 | 65.23 | 158,922 | 26.49 | 636 | 2,160 |
| 10000 | 35 | 52.35 | 13.67 | 69.90 | 145,251 | 24.21 | 581 | 2,315 |
| 12500 | 35 | 57.05 | 13.67 | 73.03 | 132,309 | 22.05 | 529 | 2,419 |
| 15000 | 35 | 60.68 | 13.67 | 75.28 | 120,889 | 20.15 | 484 | 2,493 |
| 17500 | 35 | 63.57 | 13.67 | 76.98 | 110,998 | 18.50 | 444 | 2,549 |
| 20000 | 35 | 65.93 | 13.67 | 78.30 | 102,450 | 17.08 | 410 | 2,593 |

INCLUDES MECHANICAL DOWNTIME

TABLE 5

| | | | DUAL DYE ANAL STRIKES/LOT = 1.7 SPEED = 100 HOURS/WK = 138 LDR = 3 | | | | | |
|---|---|---|---|---|---|---|---|---|
| LOT SIZE | PRESENT STRIKE TIME | EFFI-CIENCY | PROPOSED STRIKE TIME | EFFI-CIENCY | ADDITIONAL YARDS/WK/ RANGE | MACHINE HOURS SAVED | ADDED YARDS/WK FOUR RANGES (THOUS) | TOTAL YARDS/WK (THOUS) |
| 2000 | 35 | 22.39 | 13.07 | 42.15 | 163,648 | 27.27 | 655 | 1,396 |
| 5000 | 35 | 40.64 | 13.07 | 61.61 | 173,656 | 28.94 | 695 | 2,041 |
| 7500 | 35 | 40.63 | 13.07 | 68.65 | 157,538 | 26.26 | 630 | 2,274 |
| 10000 | 35 | 55.80 | 13.07 | 72.82 | 140,897 | 23.48 | 564 | 2,412 |
| 12500 | 35 | 60.30 | 13.07 | 75.56 | 126,403 | 21.07 | 506 | 2,503 |
| 15000 | 35 | 63.72 | 13.07 | 77.51 | 114,192 | 19.03 | 457 | 2,567 |
| 17500 | 35 | 66.42 | 13.07 | 78.97 | 103,934 | 17.32 | 416 | 2,615 |
| 20000 | 35 | 68.59 | 13.07 | 80.10 | 95,263 | 15.88 | 381 | 2,653 |

INCLUDES MECHANICAL DOWNTIME

While the invention has been described in connection with what is presently considered to be the most practical and preferred embodiment for a thermasol dye range, it is to be understood that the invention is not to be limited to the the disclosed embodiment, but on the contrary, is intended to cover various modifications and equivalent arrangements included within the spirit and scope of the appended claims.

What is claimed:

1. A method of producing multiple dye strikes sequentially on fabric in a continuous dye range comprising the steps of:

(a) forming a multipart textile web by joining together in a sequential arrangment a first leader, a first strike portion, a second leader, second strike portion;

(b) continuously feeding the multipart textile web through a dye range;

(c) sequentially feeding the multipart textile web through first and second dye solutions so that the first and second strike portions only pass through the first and second dye solutions, respectively; and (d) removing a portion from each of said first and second strike portions.

2. The method as in claim 1 including the further step of joining a third leader and a first dye portion to a trailing end of the second strike portion.

3. A method as in claim 1 including the further step of joining a third leader and a second length of a first strike portion to a trailing end of the second strike portion.

4. A method for sequentially preparing a plurality of dye swatches with a plurality of dye baths on a continuous dye range comprising the steps of preparing at least first and second dye baths threading a continuous dye range with a length of material, said length of material, including sequentially a first leader, a first strike patch, a second leader, a second strike patch and a third leader feeding the length of material through the continuous dye range while simultaneously positioning said first dye bath to contact the length of material, and following a predetermined period of time repositioning the first and second dye baths so that the length of material passes through the second dye bath so that the first and second strike patches, respectively, pass through the first and second dye baths.

* * * * *